United States Patent [19]

Tresch

[11] 4,321,595

[45] Mar. 23, 1982

[54] SMOKE DETECTOR

[75] Inventor: Erwin Tresch, Maennedorf, Switzerland

[73] Assignee: Cerberus AG, Maennedorf, Switzerland

[21] Appl. No.: 105,213

[22] Filed: Dec. 19, 1979

[30] Foreign Application Priority Data

Feb. 22, 1979 [CH] Switzerland ..... 1773/79

[51] Int. Cl.[3] ..... G08B 17/10

[52] U.S. Cl. ..... 340/630; 250/574

[58] Field of Search ..... 340/630; 250/573, 574, 250/575

[56] References Cited

U.S. PATENT DOCUMENTS 3,316,410 4/1967 Meili et al. ..... 340/630 X 3,946,241 3/1976 Malinowski ..... 340/630 X

*Primary Examiner*—John W. Caldwell, Sr.

*Assistant Examiner*—Daniel Myer

*Attorney, Agent, or Firm*—Werner W. Kleeman

[57] ABSTRACT

A smoke detector containing a radiation source operating in a pulsed mode and a scattered radiation receiver connected in a coincidence circuit. This circuit contains a counter which counts both the radiation pulses and the incoming scattered radiation pulses. With undisturbed operation this counter, following each radiation pulse, has an even numbered counter state. The appearance of an uneven numbered counter state is indicative of the presence of spurious pulses and leads to resetting of the counter to null, so that there is prevented attainment of a counter state adequate for tripping an alarm signal. On the other hand, with the presence of a predetermined even numbered counter state there is triggered an alarm. Such smoke detector is almost immune to spurious pulses and does not tend to trigger faulty alarm signals.

7 Claims, 1 Drawing Figure

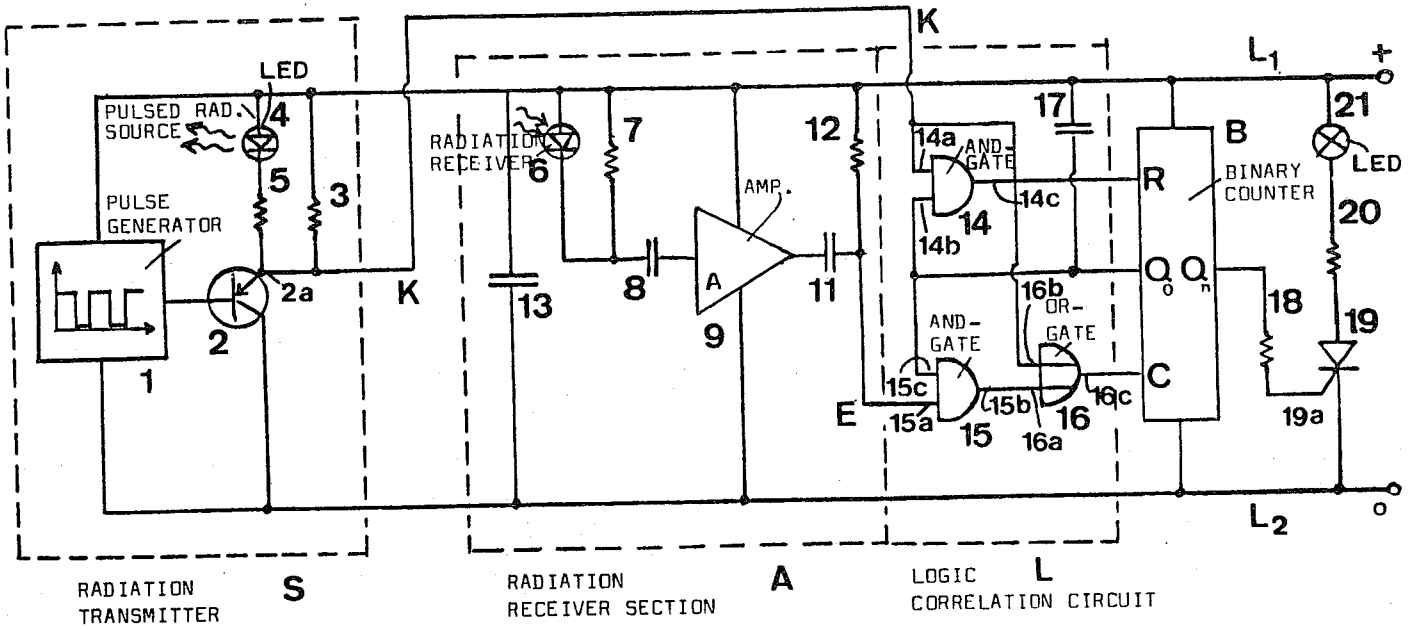
LOGIC CORRELATION CIRCUIT
L
RADIATION RECEIVER SECTION
A
RADIATION TRANSMITTER
S
BINARY COUNTER
B
AND-GATE
OR-GATE
AMP.
RADIATION RECEIVER
PULSED RAD. SOURCE
PULSE GENERATOR
LED
K
E
C
R
L1
L2

SMOKE DETECTOR

BACKGROUND OF THE INVENTION

The present invention relates to a new and improved construction of a smoke detector of the type comprising a radiation source operated in a pulsed mode, a radiation receiver arranged externally of the direct radiation region of the radiation source, the radiation receiver in the presence of smoke within the radiation region being impinged by scattered radiation and delivering output signals. Further, there is provided an evaluation circuit capable of triggering a signal when radiation pulses of the radiation source and output pulses of the radiation receiver are in coincidence.

Such type smoke detector has become known to the art for instance from U.S. Pat. No. 3,316,410. Here, a radiation source is controlled by a pulse transmitter and transmits briefly lasting radiation pulses. The evaluation circuit connected with the scattered radiation receiver is controlled by the pulse transmitter of the radiation source such that when receiving scattered radiation, it is only capable of delivering an output signal during the pulse phases of the radiation source. Spurious pulses, arising between the radiation pulses, are therefore blocked by the evaluation circuit and cannot lead to triggering a signal.

What is disadvantageous with this prior art construction is that spurious pulses, which randomly arise at the same time as the radiation pulses, can trigger a faulty signal.

To avoid this drawback it has already been attempted to connect with the evaluation circuit of a smoke detector, which operates with coincidence logic, an integrator or storage which first then delivers a signal if the evaluation circuit, within a certain time, has delivered a predetermined number of output pulses. Significant in this regard is U.S. Pat. No. 3,946,241, granted Mar. 23, 1976.

Yet, such type smoke detector, while being less prone to issuing a faulty signal, and therefore, having an improved operational reliability, nonetheless if there arise a number of spurious pulses in succession it is still possible for random ones of a number of these spurious pulses to coincide with the radiation pulses and therefore to cause tripping of a faulty signal.

SUMMARY OF THE INVENTION

Therefore, with the foregoing in mind it is a primary object of the present invention to overcome the aforementioned drawbacks of heretofore known smoke detectors and to avoid as extensively as possible faulty giving of a signal due to the occurrence of spurious pulses, and therefore, to further improve upon the operational reliability of the smoke detector, especially when using the same as a fire alarm.

Yet a further significant object of the present invention is directed to a new and improved construction of smoke detector having increased operational reliability so as to avoid delivering faulty alarm signals in a more reliable and positive fashion than was heretofore possible with the prior art proposals discussed above.

Now in order to implement these and still further objects of the invention, which will become more readily apparent as the description proceeds, the smoke detector of the present development is manifested by the features that the evaluation circuit comprises a counter which counts both the radiation source pulses and the output pulses of the radiation receiver. In the presence of an uneven counter state, following a random radiation pulse, the counter is reset to null, but upon reaching a predetermined even numbered counter state there is released a signal.

The invention exploits the fact that with the presence of smoke in the radiation region each radiation pulse must correspond in each case to a corresponding output pulse of the radiation receiver. Now if by means of a counter there are counted both the radiation source pulses and also the output pulses of the radiation receiver, then after each radiation pulse the counter must have an even numbered counting state. An uneven numbered counting state therefore is an unmistakable sign that no received pulse is present. In this case the evaluation circuit is automatically reset to null, so that the counter can no longer reach the counter state needed for giving a signal. The counter is blocked when there is not present any radiation source pulse.

BRIEF DESCRIPTION OF THE DRAWING

The invention will be better understood and objects other than those set forth above will become apparent when consideration is given to the following detailed description thereof. Such description makes reference to the annexed drawing wherein the single FIGURE shows an exemplary embodiment of an electrical circuit of a smoke detector according to the invention.

DETAILED DESCRIPTION OF THE PREFERRED EMBODIMENTS

Describing now the single FIGURE of the drawing, it is to be understood that the mechanical construction of the smoke detector may be conventional, for instance may comprise an optical smoke detector containing a radiation source, radiator conducting elements, screening elements and a radiation receiver arranged within a housing and coacting with one another in the manner as disclosed for example in Swiss Pat. No. 592,932 and the cognate commonly assigned, copending U.S. application Ser. No. 777,397, filed Mar. 14, 1977, now U.S. Pat. No. 4,181,439, granted Jan. 1, 1980, to which reference may be readily had and the disclosure of which is incorporated herein by reference.

Turning attention now to the drawing, with the circuit configuration shown therein there are arranged between two lines or conductors $L_1$ and $L_2$ carrying a directcurrent voltage, a radiation transmitter S, a radiation receiver A and a logic correlation circuit L connected with a binary counter B having a subsequently connected switching stage.

The radiation transmitter S will be seen to comprise a pulse generator 1 of conventional design, such as a commercially available integrated circuit of Motorola Corporation, type MC 1555, which, for instance, produces transmitted pulses of 100 $\mu$S duration and with a pulse interpause of one second, which are fed to a power transistor 2. At the transistor output 2*a* there is arranged a parallel circuit of a load resistance 3 and a light or infrared emitting diode 4 connected in series with a resistance or resistor 5. The diode 4 transmits to the scattered volume or region of the smoke detector radiation pulses in rhythm with the pulse generator 1. At the same time there are removed from the output 2*a* of the power transistor 2 coincidence pulses by means of a line or conductor K and infed to the logic correlation circuit L.

The radiation receiving or receiver section A contains a storage capacitor 13 as well as a solar cell 6 or equivalent structure which, in the presence of smoke in the scattered volume or chamber of the fire alarm, receives scattered radiation in rhythm with the radiation pulses of the diode 4. Connected in parallel with the solar cell 6 is a load resistor or resistance 7. The output pulses of the solar cell 6, constituting a radiation receiver, are infed by means of a capacitor 8 to an amplifier 9, for instance an operational amplifier having a gain of $10^3$, whose output signals are delivered by means of a capacitor 11 having a leakage resistance 12 to the logic correlation circuit L. The amplifier 9 equally may be a commercially available integrated circuit of Motorola Corporation type MC 1741. The received pulses E, delivered by the radiation receiving section or portion A, are exponentially flattened by suitable selection of the frequency response of the amplifier 9 and the solar cell 6. The logic correlation circuit L contains two AND-gates 14 and 15 as well as an OR-gate 16. The first AND-gate 14 has infed to its first input **14*a* the coincidence pulses K of the radiation transmitter S, whereas the other AND-gate 15 receives at its one input 15*a* the received pulses of the radiation receiving section A. The output 15*b* of this AND-gate 15 is connected with an input 16*a* of the OR-gate 16, whose other input 16*b* likewise receives the coincidence pulses K. The output 16*c* of the OR-gate 16** is connected with the counting input C of the binary counter B. Binary counter B likewise may be an integrated circuit commercially available from Motorola Corporation under type MC 14024. Counter B counts both the received pulses E and also the coincidence pulses K, and interference of both pulses is prevented by the flattened form of the E-pulse.

The counter B possesses different outputs for the individual digits or numbers of the binary counter state, for instance an output $Q_0$ for the first bit or the end number and an output $Q_n$ for the nth-bit or nth-place of the binary number. The output $Q_0$ is connected with both of the other inputs **14*b* and 15*c* of both AND-gates 14 and 15, respectively, whereas the output 14*c* of the AND-gate 14 is connected with a resetting or reset input R of the binary counter B, so that the counter state is reset to null as soon as there appears a signal at the output 14*c* of the AND-gate 14. The output $Q_0$ is connected with the line $L_1$ by means of a time-delay capacitor 17**.

By means of this circuit there is ensured that without the presence of smoke in the scattered volume or chamber of the fire alarm, in other words during the absence of the received pulses E, by means of the OR-gate 16 there is counted at the counter input C of the counter B, at the start of each transmitted pulse, only a coincidence pulse. At the output $Q_0$ there thus appears the logic signal 1. Directly after expiration of the coincidence pulse there appears at the output **14*c* of the AND-gate 14** a signal, so that the counter B is reset again to null by means of a reset input R. Upon the absence of scattered radiation, in other words upon the non-presence of received pulses, the counter B therefore does not continue to count any further.

However, if there appears a coincidence pulse K and after a certain time delay a received pulse E, then by means of the OR-gate 16 a counting pulse K directly arrives at the counter or counting input C and also with a time delay a received pulse E by means of the AND-gate 15 and the OR-gate 16. As a result at the end of the coincidence pulse the counter state is an even number, in other words the final digit null appears at the output $Q_0$, so that the AND-gate 14 is blocked and the reset input R does not receive any signal. The counter B thus counts further, and the counter state always is an even number, in other words there appears at the output $Q_0$ the signal null when, in each case, there have arrived related coincidence pulse and a received pulse. During the duration of the transmitted pulse there only can be read into the counter, along with the coincidence pulse, at most one received pulse.

At the n-th output $Q_n$ of the counter B there is connected by means of a resistor 18 the control electrode **19*a* of a thyristor 19 or equivalent means connected in series with a resistance 20 and a display or indicator device 21, for instance a light emitting diode, between the lines $L_1$ and $L_2$. As soon as the counter state has reached a predetermined value, i.e. as soon as the nth digit, for instance the fourth digit of the binary number has become 1, i.e. when Qn goes from a low state to a high state, then the thyristor 19 is fired and an alarm current flows which activates the indicator device 21** and therefore signals the presence of smoke. Upon connection of the fire alarm with a central signal station there additionally flows an alarm signal from the connection terminal of the fire alarm to the central signal station, which at that location likewise can be evaluated in known manner for giving a signal.

It is remarked that the logic correlation circuit L also can be designed as an integrated circuit having the same function.

Due to the described circuitry there is obtained the advantage that only will there be triggered an alarm signal if at the same time or within a certain time delay there arrive both a coincidence pulse received from the radiation transmitter and also a received pulse delivered by the radiation receiver and if such correlated received pulses appear in succession a predetermined number of times. If however only a single pulse arrives, either because owing to the absence of smoke there does not appear any received pulse or because of a disturbance, then there is automatically blocked the giving of any signal. This correlated multipulse dependency therefore appreciably improves the sensitivity against disturbance or malfunction of the fire alarm.

While there are shown and described present preferred embodiments of the invention, it is to be distinctly understood that the invention is not limited thereto but may be otherwise practised within the scope of the following claims. Accordingly,

What I claim is:

1. In a smoke detector having a radiation source operated in a pulsed mode, a radiation receiver arranged externally of a direct radiation region of the radiation source, the radiation receiver being impinged in the presence of smoke in the radiation region by scattered radiation and delivering output pulses, and an evaluation circuit capable of triggering an alarm when radiation pulses of the radiation source and output pulses of the radiation receiver are in coincidence, the improvement which comprises:

said evaluation circuit containing a counter;

said counter counting both the radiation source pulses and also the output pulses of the radiation receiver; and said evaluation circuit comprising means for resetting said counter in the presence of an uneven counter state to null after a random radiation pulse, but upon reaching a predetermined even numbered counter state triggering a signal.

2. The smoke detector as defined in claim 1, wherein:

said counter comprises a binary counter; and said resetting means of said evaluation circuit including a resetting device for resetting the counter to null upon occurrence of the binary end number 1 of the binary counter state.

3. The smoke detector as defined in claim 2, wherein:

said resetting device resets the counter when, directly following a transmitted pulse, the end number of the binary counter state is 1.

4. The smoke detector as defined in claim 2, wherein:

said resetting device resets the counter to null when the end number 1 of the binary counter state appears for a predetermined time duration.

5. The smoke detector as defined in claim 2, wherein:

said resetting device is inhibited during the duration of the radiation pulses.

6. The smoke detector as defined in claim 2, wherein:

said counter delivers a signal when a predetermined other binary number of the counter state becomes 1.

7. The smoke detector as defined in claim 2, wherein:

said resetting device comprises a logic correlation circuit;

said logic correlation circuit containing two AND-gates each having two inputs and an output;

the received pulses of the radiation receiver being infed to one input of one of the AND-gates and to one input of the other AND-gate there being infed the radiation source pulses and to both other inputs of said AND-gates there being infed an end digit signal of the binary counter;

an OR-gate which is operatively associated with the radiation source pulses and the output signal of said one AND-gate operatively correlated with the radiation receiver;

said OR-gate having an output connected with a counting input of the binary counter; and the output of the other AND-gate being connected with a resetting input of the binary counter.

* * * * *